United States Patent [19]

Beisswanger et al.

[11] Patent Number: 4,700,658

[45] Date of Patent: Oct. 20, 1987

[54] DEVICE FOR COATING TRAVELING MATERIAL

[75] Inventors: Rudolf Beisswanger, Steinheim; Albert Wohrle, deceased, late of Heidenheim, by Ingrid Wohrle, executor; Anton Plomer, Heidenheim, all of Fed. Rep. of Germany

[73] Assignee: J. M. Voith, GmbH, Heidenheim, Fed. Rep. of Germany

[21] Appl. No.: 794,506

[22] Filed: Nov. 4, 1985

[30] Foreign Application Priority Data

Nov. 7, 1984 [DE] Fed. Rep. of Germany ..... 3440634

[51] Int. Cl.[4] ..... B05C 3/132; B05C 5/02

[52] U.S. Cl. ..... 118/67; 118/405; 118/411

[58] Field of Search ..... 118/206, 259, 410, 413, 118/414, 227, 67, 405, 411

[56] References Cited

U.S. PATENT DOCUMENTS

| | | | |
|---|---|---|---|
| 3,089,460 | 5/1963 | Mahoney et al. | 118/67 X |
| 4,259,921 | 4/1981 | Wallsten | 118/414 X |
| 4,325,784 | 4/1982 | Dreher | 118/206 X |
| 4,357,370 | 11/1982 | Alheid | 118/206 X |
| 4,413,586 | 11/1983 | Wohrle | 118/206 |

*Primary Examiner*—John P. McIntosh

*Attorney, Agent, or Firm*—Jeffers, Hoffman & Niewyk

[57] ABSTRACT

A device for coating traveling material webs wherein the coater features two opposite press rolls capable of forming therebetween a coating mixture sump. Each press roll features at its side opposite from the other press roll a coater provided with a doctor blade. In the application of sizing to the web, the last reversing roll in the direction of web travel is arranged above the press rolls. In the application of coating, to the web, the last reversing roll located in the direction of web travel before the first coater is arranged below the two press rolls.

6 Claims, 2 Drawing Figures

DEVICE FOR COATING TRAVELING MATERIAL

BACKGROUND OF THE INVENTION

The invention is directed to a device for coating traveling material webs, and more specifically, the invention is directed to a device for coating a traveling material web wherein there is included two essentially horizontally opposed press rolls wherein at least one press roll is moveable relative to the other and wherein in conjunction with at least one press roll there is provided a coater that comprises a doctor blade.

A device for coating traveling material webs is previously known from the U.S. Pat. No. 4,259,921. This device is suited for performing both the sizing of the paper where the paper web is passed through a coating gap formed between two press rolls, and for performing a coating operation on both sides of the paper web. For the latter purpose, a sump is formed on one of the press rolls on its side facing away from the press gap through which the paper web is passed from above and which on the other end is defined by a doctor blade and its support which removes excess coating mixture from the web. First, this arrangement has the disadvantage that the coating thickness on the two different sides cannot be regulated separately. Second, this arrangement possesses the still greater disadvantage that while the web is passing through the sump the moisture of the coating mixture can for an extended time penetrate the paper from both sides resulting in a break of the paper web. Basically, this arrangement has the disadvantage that it requires an extremely accurate monitoring of the doctor blade angle relative to the tangent with the press roll at the point and/or line of contact with the doctor blade, and an extremely accurate monitoring of the angle at which the material web leaves the pressure roll and/or the doctor blade.

Various coaters are known wherein the coating mixture applied in excess is subsequently removed down to the desired coating thickness from the paper web passing over the press roll with the aid of a doctor blade. In such a process, appropriate nozzle applicators according to the U.S. Pat. No. 4,250,211 or other nozzle applicators featuring a pressure channel according to U.S. Pat. No. 3,418,970 are recommended for the coating devices. A favorable blade coater is also shown by the U.S. Pat. No. 4,169,425.

Such coating devices occupy a rather large space, and this is especially true when both sides of the paper web are to be coated as shown in the publication Pulp and Paper International 1966, pages 65 through 70. Such systems may occupy even more space when such a system provides for the operation of both a coating device and the previously mentioned sizing press. In paper production, customer requirements vary so that the papermaker must be prepared to accommodate these various requirements.

SUMMARY OF THE INVENTION

The problem to which the invention is directed is to provide a device which comprises a coating device and a sizing press, and which requires little construction space so as to be very cost-effective and operationally safe while providing a high-quality coating.

This problem is solved with the coating device of the invention wherein each press roll forms with the doctor blade and a pressure channel type of applicator a coater wherein the doctor blade is always arranged on the press roll side facing away from the other press roll. In regard to the sizing press, the last reversing roll is located in the direction of web travel before the two press rolls and is arranged above the two press rolls. The last reversing roll for the coating assembly is located in the direction of web travel before the first coater and is arranged below the two press rolls.

The coating arrangement is designed so that the space between the nozzle or pressure channel mouth and the doctor blade edge is very small. This design will favorably reduce to a minimum the penetration time of the moisture in the coating mixture. Another advantage with this coating arrangement is that the operator has a relatively free hand in selecting a coater arrangement that provides the most favorable operational characteristics.

Further, this coating arrangement makes it readily possible to apply with the two coaters a thin sizing film on the press rolls and size the paper in the press gap between the press rolls thereby advantageously avoiding the sizing sump which is often difficult to manage.

The above-mentioned and other features and objects of this invention and the manner of attaining them will become more apparent and the invention itself will be best understood by reference to the following description of embodiments of the invention taken in conjunction with the accompanying drawings.

DETAILED DESCRIPTION OF SPECIFIC EMBODIMENTS

Figure 1:
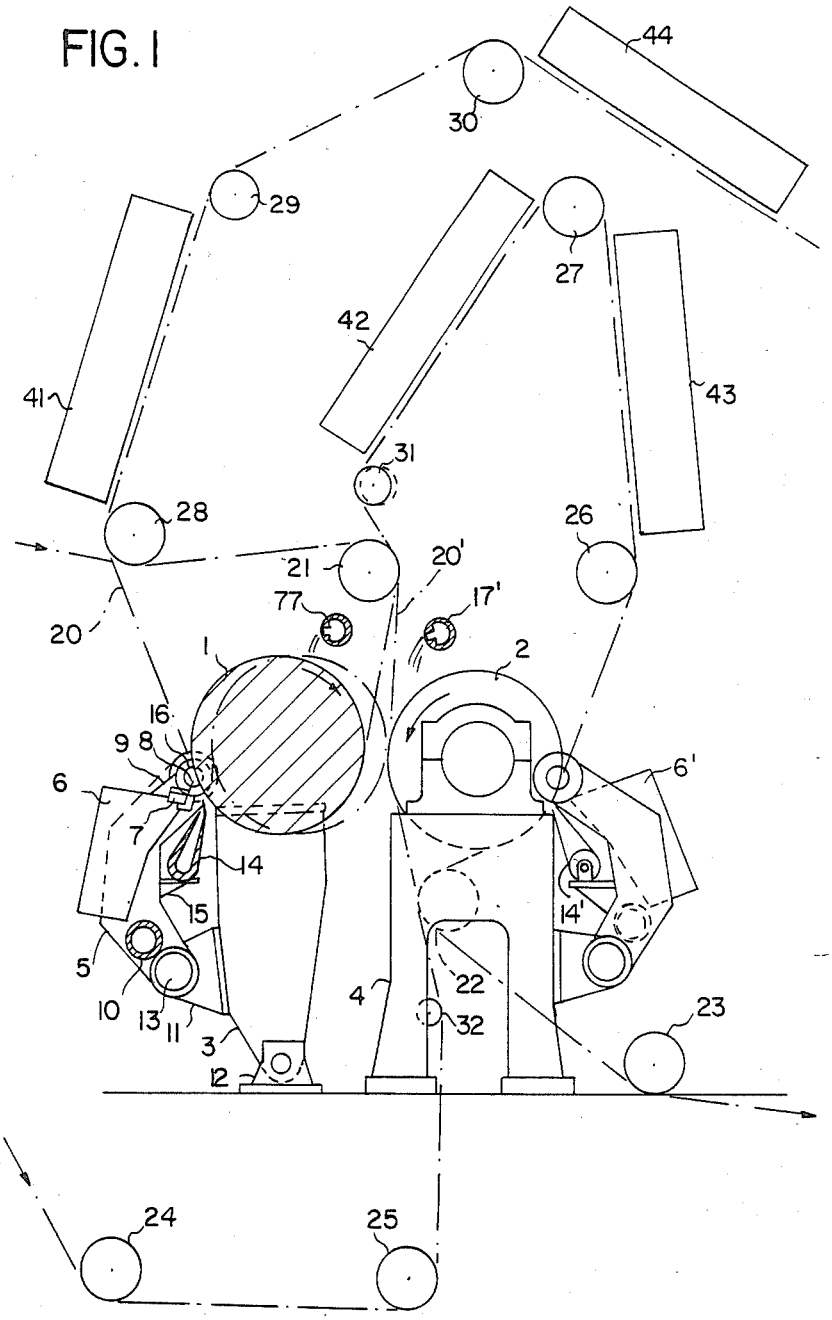
FIG. 1 is a side view of one specific embodiment of the invention.

Referring to the drawings, the two press rolls 1 and 2 are oppositely disposed in essentially the same horizontal plane, and are spaced a slight distance apart. The spacing apart of the rolls 1 and 2 can be varied because the support 3 of the roll 1 shown on the left in the figures pivots in the pillow block 12. This makes it possible to swing the left roll 1 in the position illustrated by the dash-dotted lines in the figures. As illustrated by dash-dotted lines in FIG. 1, the paper web 20' runs from top to bottom through the very narrow gap between the two press rolls 1 and 2. The sizing is fed into the gore or gap formed between the surfaces of the press rolls and the paper web by means of sizing pipes 17 and 17' so that a sump will form thereat. Excess sizing is then removed through the application pressure of the two rolls leaving only the necessary amount of sizing on the paper web. Reversing rolls 24 through 32 (see FIG. 1) provide a different web threading path so as to move the paper web 20 onto the coaters as is illustrated by the double-dotted line. For that purpose, the left press roll 1 must be located in the solid-line position as shown in FIG. 1. The coating device also includes a doctor blade, or a coating blade, 8 which is attached to a holder 7 which, in turn, is supported by a beam 6 which with the aid of support arms 9 and through bearing bolts 16 is held on lateral swivel arms 5. These swivel arms 5 are part of a rugged frame where a tie pipe 10 connects the lateral swivel arms 5. This stiff frame rests with its swivel arms 5 in console bearings 11 through the intermediary of bolts 13. The consoles bearings 11 are attached to the respective supports 3 and 4 of the press rolls. A nozzle type applicator with a nozzle chamber 14 is used as an applicator in this case. Applicator 14 is supported by consoles 15 which are attached to the lateral swivel arms 5. In regard to the coating operation, that is, in the case of the web 20 which is coated, heaters 42 and 43 are provided between the first and second coaters so as to dry the web prior to the second coating operation. Following application of the second coating, heaters 41 and 44 dry the other side of the web.

Referring to the left and right hand coaters, the nozzle chambers 14, 14' are mounted on their respective consoles in a pivotable fashion as can be seen from the right hand coater in FIG. 1. The coating blade and the nozzle chamber can now be swiveled in such a fashion that the space between the nozzle chamber mouth and the coating blades, as measured closely along the respective press roll, will be extremely small. Because this space is small, there is left only a little possibility for the coating mixture moisture to penetrate the paper web.

Further, it is recommended to use the coater known from U.S. Pat. No. 4,250,211 wherein the nozzle chamber also acts as coating blade support. This type of arrangement further shortens the possible reaction time of the coating mixture moisture on the paper web. Besides, this arrangement is advantageous because it takes up very little space. In this case, the nozzle chamber 14 with its console 15 would then have to be mounted on the support beam 6.

As shown by the drawing, the arrangement of the invention requires very little space. Because of the heaters, this device is built essentially upwardly, but the space above the press rolls, i.e., underneath the factory building roof, is available anyway, and any enlargement thereof requires only insignificant additional costs.

Figure 2:
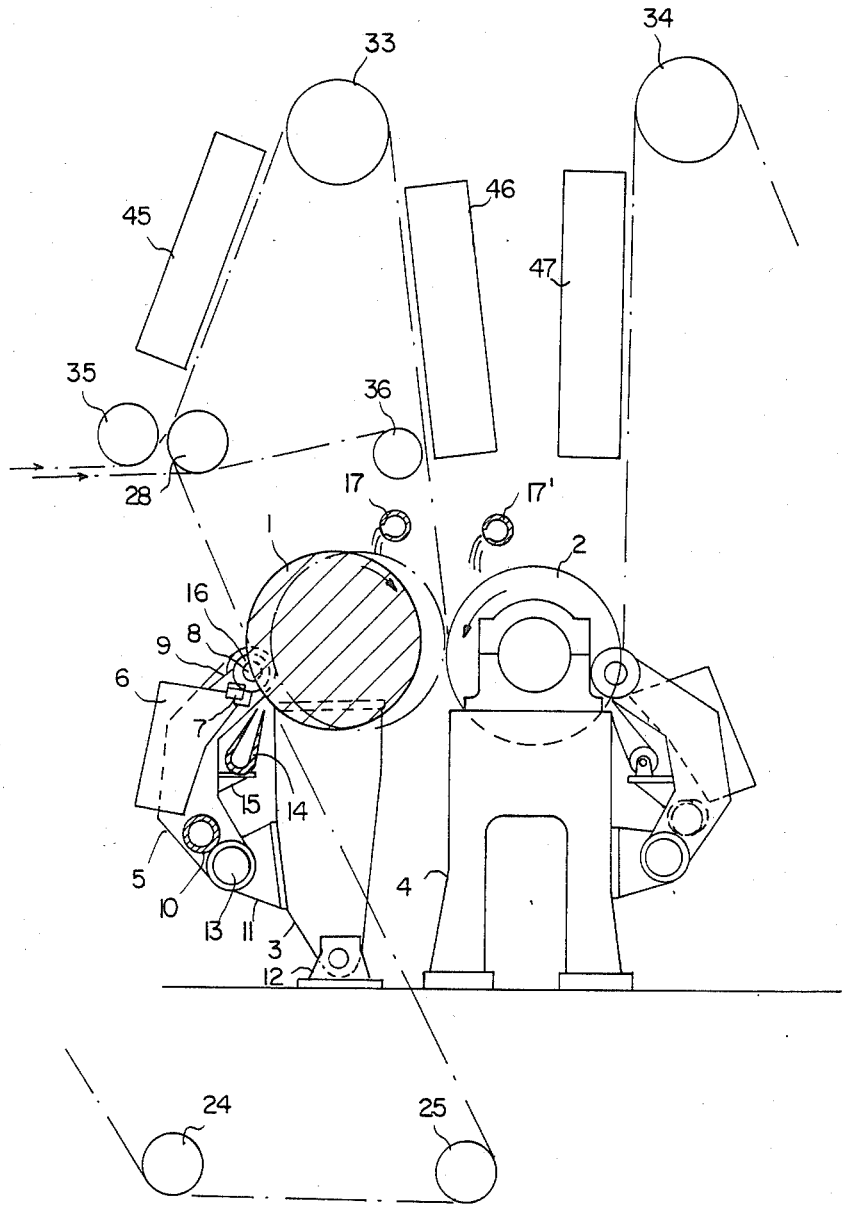
FIG. 2 is a side view of another specific embodiment of the invention.

Referring to FIG. 2, the web threading above the press rolls 1, 2 may be essentially the same both for the sizing press and the coating device.

The reversing rolls 24, 25, 28, 33 and 34 are the same for both the coating device and the sizing press. For the coating press, the heaters 45 through 47 are used to dry the coating. In the illustrated specific embodiment it is preferred that these heaters be positioned overhead, and therefore, they do not require additional floor space. As such, floor space requirements are very low for both specific embodiments since the coater and the press device are contained in a narrow space and feature few components such as bulky roll arrangements with many rolls and the like. In these specific embodiments, few reversing rolls are needed, and the web threading is short and clear.

In the case of the sizing press, it is possible when threading the paper web approaching from the paper machine to skip the reversing rolls 24 and 25 and thread the paper web immediately around the reversing roll 28 or an additional reversing roll 35 so that the rope carrier paths will not interfere with one another. This would be the case with a "short" threading of the web by means of an additional reversing roll 36. When changing over from one type of coating to another the carrier ropes would then have to be changed.

All of the reversing rolls located above the setup are, at least in the first specific embodiment, the same for both coating applications, and it is also evident that very few reversing rolls are necessary in the overal arrangement.

While there have been described above the principles of this invention in connection with specific apparatus, it is to be clearly understood that this description is made only by way of example and not as a limitation to the scope of the invention.

What is claimed is:

1. A device for coating and sizing traveling webs comprising:

two press roll oppositely disposed in essentially the same horizontal plane, said press rolls being movable relative to one another to define a sizing press gap therebetween adapted to receive the web therethrough and provide sizing of the web, at least one sizing feed means disposed above one of said press rolls upstream of said sizing press gap therebetween for feeding sizing between said one roll and the web, a coater assembly being coordinated with and disposed adjacent to at least one of said press rolls, said coater assembly including a doctor blade and a nozzle type applicator being arranged on the side of said one press roll facing away from the other press roll, a plurality of first reversing rollers adapted to direct the web into the sizing press gap between the press rolls wherein the last of said first rollers located upstream of the sizing press gap is positioned above the press rolls, and a plurality of second reverseing rollers adapted to direct the web into the coating assembly wherein the last one of said second rollers upstream of the coating assembly is positioned below the two press rolls.

2. The device of claim 1 wherein said coater assembly further comprises a roll support supporting each press roll, and said doctor blade pivotally mounted to the roll support of its corresponding said one press roll.

3. The device of claim 1 further comprising a drying means, positioned above the press rolls, for drying the web.

4. A device for coating and sizing a traveling material web comprising:

a pair of press rolls oppositely disposed in the same general horizontal plane and being movable relative to each other to define a sizing press gap therebetween adapted to receive the web therethrough and provide sizing of the web, sizing feed means dispossed in spaced relation above each of said press rolls upstream of said sizing press gap therebetween for feeding sizing between said each roll and respective opposite side of the web, a coater assembly disposed adjacent to and coordinated with each of said press rolls wherein each coater assembly includes a doctor blade and a nozzle type applicator being positioned on the side of its corresponding press roll away from the other press roll, one of said coater assemblies being located downstream of the other coater assembly with respect to the direction of travel of the web, and a plurality of reversing rollers adapted to direct the web into both coater assemblies and the sizing press gap between the press rolls, the last one of said rollers upstream of the sizing press gap and the downstream coater assembly being positioned above the press rolls.

5. The device of claim 4 wherein all of the reversing rollers positioned above the press rolls are adapted to direct the web to the press gap and the downstream coater assembly.

6. The device of claim 4 wherein all of the reversing rollers are adapted to direct the web to both coater assemblies and the press gap.

* * * * *

UNITED STATES PATENT AND TRADEMARK OFFICE

CERTIFICATE OF CORRECTION

PATENT NO. : 4,700,658

DATED : October 20, 1987

INVENTOR(S) : Rudolf Busswanger

It is certified that error appears in the above-identified patent and that said Letters Patent is hereby corrected as shown below:

In the Title, after "MATERIAL" insert --WEBS--;
Claim 1, Col. 4, line 6, change "roll" to --rolls--;
Claim 1, Col. 4, line 25, change "reverseing" to --reversing--.

Signed and Sealed this

Fifteenth Day of March, 1988

*Attest:*

DONALD J. QUIGG

*Attesting Officer*

*Commissioner of Patents and Trademarks*